United States Patent [19]

Collina et al.

[11] Patent Number: 4,601,593

[45] Date of Patent: Jul. 22, 1986

[54] HIGH QUALITY PRINTING METHOD

[75] Inventors: Giancarlo Collina, Cermenate; Giannico Stefani, Arese, both of Italy

[73] Assignee: Honeywell Information Systems Italia, Milan, Italy

[21] Appl. No.: 758,860

[22] Filed: Jul. 24, 1985

Related U.S. Application Data

[63] Continuation of Ser. No. 598,625, Apr. 10, 1984, abandoned.

[30] Foreign Application Priority Data

Apr. 12, 1983 [IT] Italy ..... 20539 A/83

[51] Int. Cl.[4] ..... B41J 3/10

[52] U.S. Cl. ..... 400/121; 101/93.04; 400/124

[58] Field of Search ..... 400/121, 124; 101/93.04, 93.05; 364/900

[56] References Cited

U.S. PATENT DOCUMENTS

| | | | |
|---|---|---|---|
| 3,759,359 | 9/1973 | Stellmach | 400/124 |
| 4,033,444 | 7/1977 | Beery | 400/124 |
| 4,159,882 | 7/1979 | Sanders et al. | 101/93.05 X |

FOREIGN PATENT DOCUMENTS

| | | | |
|---|---|---|---|
| 146162 | 1/1981 | Fed. Rep. of Germany | 400/121 |

*Primary Examiner*—Paul T. Sewell

*Attorney, Agent, or Firm*—Nicholas Prasinos; John S. Solakian

[57] ABSTRACT

A high quality printing method utilizing a matrix serial printer having a print head provided with needles arranged in a vertical column. The method comprises the steps of printing a print line in two print passes, and in advancing a platen, between the first and the second pass, by an amount equal to one and a half times the vertical pitch, center to center, between two contiguous needles.

1 Claim, 7 Drawing Figures

HIGH QUALITY PRINTING METHOD

This application is a continuation of application Ser. No. 598,625 filed Apr. 10, 1984 now abandoned.

BACKGROUND OF THE INVENTION

1. Field of the Invention

The present invention pertains to a high quality printing method utilizing a dot matrix serial printer.

2. Description of the Prior Art

In data processing systems and communication systems fast dot matrix printers are widely used. In such printers a print head provided with a plurality of printing needles, arranged in a vertical column, slides transversely on a printing support. The selective and timed actuation of the needles during the head movement causes the printing of characters by actuating pre-established needles of the matrix. Generally printing heads with 7 and 9 needles per line and 5 or 9 needles per column are used. These generate characters comprised of dots by causing selected needles to impinge on a paper to form a desired character. However the quality of these characters is limited by the number of the discrete dots which are utilized in the matrix. Nevertheless this technique provides high printing speed. Accordingly it is desirable to improve the technique so that the print quality is equivalent to that obtained by using solid fonts. A typical solution to this problem is disclosed in U.S. Pat. No. 4,159,882. The specification of this patent describes a conventional head having 7 or 9 needles vertically arranged with a pitch p between the centre of two contiguous needles (the needle diameter being slightly smaller than p). The printing of characters in a line is performed with several printing passes in order to increase the vertical resolution and to obtain vertical lines where the print dots overlap. Between one print pass and a subsequent one the printing support is vertically advanced by a submultiple of pitch p; i.e., $\frac{1}{2}$ or $\frac{1}{4}$. In this manner characters comprised of dots arranged according to a 28 line matrix can be obtained with a four pass printing by using a 7 needle head. The horizontal resolution of the matrix is increased by means of electronic circuits which enable the actuation of the needles in correspondence to subsequent printing positions. These printing positions occur at distances smaller than the diameter of the print head needles. This solution requires complicated mechanical devices and is expensive.

There are several problems that need attacking to obtain a cheaper and less expensive device. Because the pitch p between contiguous needles is 1/72" (0.35 mm) and the needles have a slightly smaller diameter (0.33 mm) than the pitch very complicated and precise equipment is necessary to advance the printing support by a half or a quarter of 0.35 mm, i.e 1/144" (0.175 mm) or 1/288" (0.0875 mm). One such piece of equipment is a step motor with a large number of poles. The step motor must be directly coupled to a printing support feeding roller. The feeding roller must be of the friction type that is able to assure sufficient contact surface between feeding device and the support being fed. Further it has to have a suitable friction coefficient. It has been experimentally determined that the use of different types of feeding mechanism is not suitable in providing such small increments of the support. Such small increments excludes pin tractors because of elastic deformation which takes place at the supporting edges, which is a large percentage of the shift. This is due to the friction between the fixed part of the printer and the printing support; in fact the local shift of the support in correspondence to the tractors does not cause sufficient local tension in the support necessary to overcome the starting friction.

Additionally the use of an economical step motor, with a small number of poles and therefore with a high angle of rotation between a stable position and the subsequent position is also excluded. Assuming that a typical pass angle for such a motor is 7.5°; a direct coupling of such motors to the feeding roller would require the use of feeding rollers having a diameter of few millimeters. Therefore the use of reduction gears with a reduction ratio of about $1/15 \div 1/30$ is necessary. Such a ratio may be obtained with several reduction gears but introduces slack equal to the desired shift. Moreover such a ratio requires one reduction gear having special teeth, thus adding to the expense.

We will consider next the speed limits of the support shift because of the use of a step motor having a large number of poles or because of the use of reduction gears. Generally matrix serial printers are bidirectional; that is, they are able to print during passes from the left to right as well as from right to left. A pass generally requires less than 1 second to be executed. The advance of the support between a pass and the subsequent one must, therefore, be executed in the shortest possible time. For instance, the execution of a line feed in 100 msec time, affects the printer throughput by 10%. The currently used line spacing has a width of 1/6" or $\frac{1}{8}$" (respectively 4.25 mm and 3.18 mm). If a support advances 1/288" (0.0875 mm) at each step motor pass, a line feed advance of 1/6" requires 48 motor passes. Likewise a lead of $\frac{1}{8}$" requires 36 motor passes. It is known that the step motors have a limited speed range, of N passes per second, within which they may operate with an almost constant rated torque. Beyond a predetermined speed the torque rapidly decreases. It is therefore required that the line feed be performed with a smaller number of motor passes in order not to penalize the execution time of the line feed.

These disadvantages are overcome by the high quality printing method of the present invention, which may be used with fast and economical dot matrix printers where character printing is performed according to a convention 9×5 or 9×9 dot matrix.

OBJECTS OF THE INVENTION

A primary object of the invention is to provide an improved high quality printing method.

Another object of the invention is to provide an improved high quality printing method utilizing needle-type print heads.

These and other objects of the invention will become apparent from a description of the preferred embodiment when read in conjunction with the drawings contained herewith.

SUMMARY OF THE INVENTION

According to the invention the high quality printing is obtained by having a first print pass followed by a print support advance equal to 1.5 times the vertical pitch between two needle axis which is then followed by a subsequent pass. In this manner the print support is advanced about 1/48" (0.53 mm) which does not require a pin tractor feeding device. The feeding device is operated by a low-cost step motor with low reduction ratios (1/5). It also utilizes a single toothed gear which involves little slack. Moreover, the line feed operations may be implemented with fewer motor steps because the elementary motor step may tally with the elementary advance of the printing support of 1/48" (0.53 mm); high line feed is therefore obtained.

A preferred embodiment of the invention has a 9 needle head. The use of a 9 needle head enables the character printing utilizing dots which are arranged according to an 18 line matrix having an arbitrary number of needles per column. The line distribution is not uniform. A central field of the matrix has 16 lines uniformly spaced with a pitch equal to half of the pitch, centre to centre, between two contiguous needles. Above the first line of the central field a print line is available at a distance equal to the pitch, centre to centre, between two needles. Below the last line of the central field a print line is available at a distance equal to the pitch, centre to centre, between two needles. In effect, the central field may be used for the high quality print head according to a matrix of 16×N. The upper line can be used for accent marks, "umlaut" and overscoring. The lower line can be used for underscoring. With such a 16×N matrix character generators can be efficiently utilized because such character generators are byte arranged; that is, with a parallelism of 8 bits. The underscorings or overscorings are not generally included in the character description but they are obtained by sum of the letter description with additional information.

BRIEF DESCRIPTION OF THE DRAWINGS

These and other features will appear more clearly from the following description of the invention and from the enclosed drawings where.

GENERAL DISCUSSION

Figure 1:
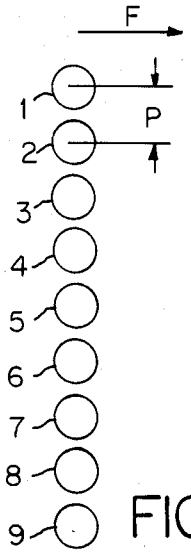
FIG. 1 shows the needle ends of a print head preferably used in carrying out the method of the invention.
Figure 2:
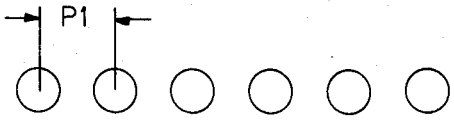
FIGS. 2 and 3 show horizontal marks obtainable with the head of FIG. 1 depending on the head speed, wherein the needle actuation frequency remains the same.
Figure 3:
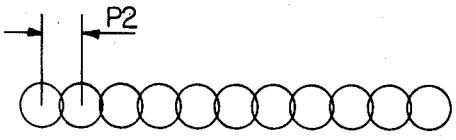
Figure 4:
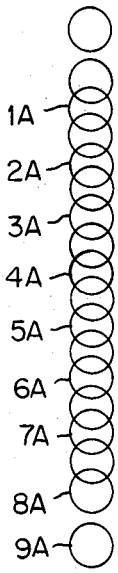
FIG. 4 shows the vertical printing positions obtainable by the method of the invention.

Referring to FIG. 1, there is shown the ends 1, 2, . . . 9 of the printing needles of one column of a dot matrix printing head known in the art. The needles, have a circular section, and a diameter D of about 0.33 mm and their ends are arranged with a distance P, centre to centre, of 1/72" (0.352 mm). Each of the needles can be selectively actuated perpendicularly to the plane of the drawing in order to produce a circular point (equal to the needle diameter) on a printing support coincident to the plane of the drawing. The simultaneous operation of all the needles allows the marking of a vertical segment consisting of 9 dots on the printing support hereinafter referred to as "paper". The segment "granulation" is immediately visible. The print head slides on the paper in a horizontal direction shown by the arrow F. For instance a head transfer speed F of 10"/sec is commonly used (25.4 cm/sec.). A needle operation requires a certain time. A maximum actuation frequency therefore exists. Such frequency depends on the kind of the head and may range from 500 Hz, for low-cost heads, to 2000 Hz for high-performance heads. The printing of a horizontal line comprised of dots having a pitch P1, centre to centre, equal to 1/50" (0.508 mm) is obtained (FIG. 2), if the same needle 1 of FIG. 1 is actuated in succession at the frequency of 500 Hz, and a transfer speed of 10"/sec (25.4 cm/sec). The "granulation" of a line obtained in this manner is immediately visible. It is, however, clear that by reducing the head speed, for example, to 5"/sec (12.7 cm/sec) a horizontal line is obtained comprised of dots having a pitch P2, centre to centre, equal to 1"/100 (0.254 mm). In this example the printed dots with 0.33 mm diameter partially overlap forming a continuous line (FIG. 3). Good printing quality is therefore obtained for the horizontal segments by suitably reducing the speed of the head depending on the maximum frequency allowed for the needle actuation. Quality printing for vertical or inclined segments is obtained with two printing passes and with the advance of the printing support between one pass and a subsequent one, equal to H=1.5P; that is 1/48" (0.53 mm). As shown in FIG. 4 with 1A, 2A, . . . 9A, the horizontal printing positions obtained by the first pass add to the horizontal printing positions obtained by the second pass. The set of all the obtainable horizontal printing positions together with the transverse shifting of the head defines a matrix of possible printing positions where the column number N varies in accordance to the head speed and to the instant of actuation of the needles relative to the head position. (The horizontal resolution is beyond the scope of this invention.)

Figure 5:
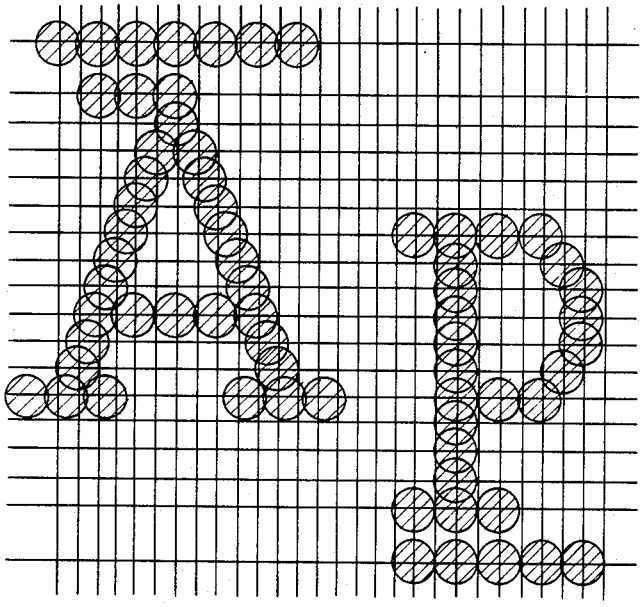
FIG. 5 shows an example of quality characters obtainable by the method of the invention.

The number of lines in the print matrix is equal to 18 distributed as follows: A matrix central field consisting of 16 printing lines uniformly spaced by a vertical path equal to 1/144" (0.175 mm). In such a field, the vertical marking of all the possible printing positions comprises a continuous segment where the printed dots, each of a diameter of 0.33 mm, widely overlap with continuous dots. In case of inclined segments the partial overlapping of contiguous dots is still obtained for a wide slope range from 0° to more than 45° from a vertical line. Dot composed characters having an excellent printing quality are therefore obtained and letters A and p are shown in FIG. 5 as examples. Above the central field a dot printing line is available with a centre distance relative to the contiguous one is equal to 1/72" (0.352 mm). These printing positions can be used for overscoring the letters composed in the central field of the matrix. The overscoring printing does not interfere with and does not overlap the printing in the field below. Likewise, a line of dot print positions is available below the central field with a distance relative to the contiguous one equal to 1/72" (0.352 mm). Such printing positions can be used for underscoring letters composed in the central field of the matrix. The underscoring printing does not interfere with and does not overlap the impressions in the upper field. (FIG. 5 provides an overscoring and an underscoring example.)

Figure 6:
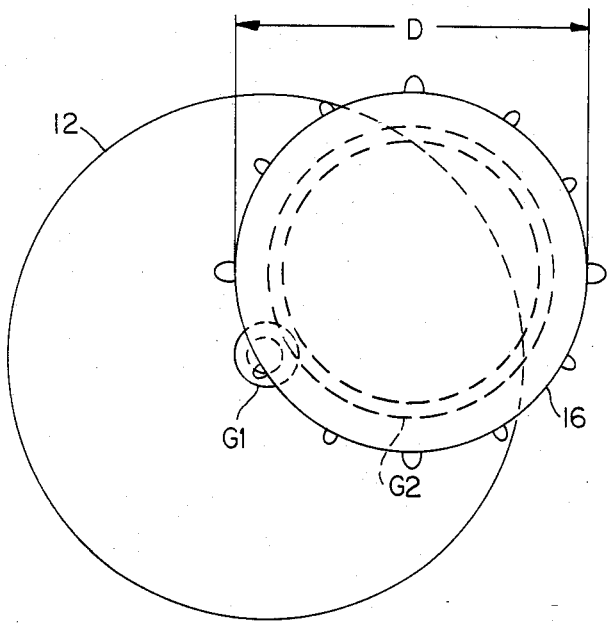
FIG. 6 shows a preferred embodiment of the printing support feeding mechanism used in carrying out the method of the invention.

Referring to FIG. 6 the printing support advance between one printing pass and a subsequent one is suitably obtained with one step of a step motor 12 (FIG. 6). An economical type step motor may have a pass angle equal to 7.5°. The printing support can be advanced with pin wheels 16 having a feeding circumference equal to 5" (12.7 cm) corresponding to a diameter D of about 4 cm. This is a usual size for feeding wheels used in printers. A paper feed of 1/48" (0.53 mm) corresponds to an angular rotation of 1/240 of circumference; that is, of 1.5°, for wheels of the mentioned size. This angular rotation can be obtained by coupling the step motor to the pin wheels through a reduction toothed pair G1, G2 having a ratio of 1:5. Such pair may be easily implemented with conventional teeth having involute profile and involving little slack. The use of such feeding mechanism permits standard line feed passes of 1/6" and ⅛" through 8 and 6 motor steps respectively. High paper feeding speed can therefore be obtained.

The invention provides also advantages in terms of electronic control architecture character description matrixes (character generators). Referring now to FIG. 6 there is shown, in schematic form, the architecture of an electronic control system of a printer capable of carrying out the method of the invention. The system comprises a microprocessor 10, a programmable I/O gate 11, a register 13, a control memory 14 and a programmable communication interface 15. All such devices are commercially available. For example, the above-mentioned devices are marketed by a U.S. firm INTEL as follows:

| | |
|---|---|
| microprocessor 10: | code 8085 |
| programmable gate 11: | code 8155 |
| control memory 14: | code 8316A |
| programmable communication interface: | code 8250. |

Register 13, which may be an 8 bit register is marketed by several integrated circuit manufacturers (Texas Instruments, Fairchild, Motorola) having code: LS 373. (For detailed information about such devices reference is made to manufacturer manuals.)

Microprocessor 10 is supplied with 8 input/output pins, for data and addresses, which are connected to 8 leads. These leads constitute bus AD0–7. Microprocessor 10 is provided with 8 address output pins which are connected to 8 leads. These leads comprise address bus A8–15. Microprocessor 10 is further provided with:

an output CK for sending a cyclical timing signal to other system components, an output ALE for sending an address "strobe" signal, two interrupt inputs RST and TRAP for receiving two separate program interrupt signals.

Figure 7:
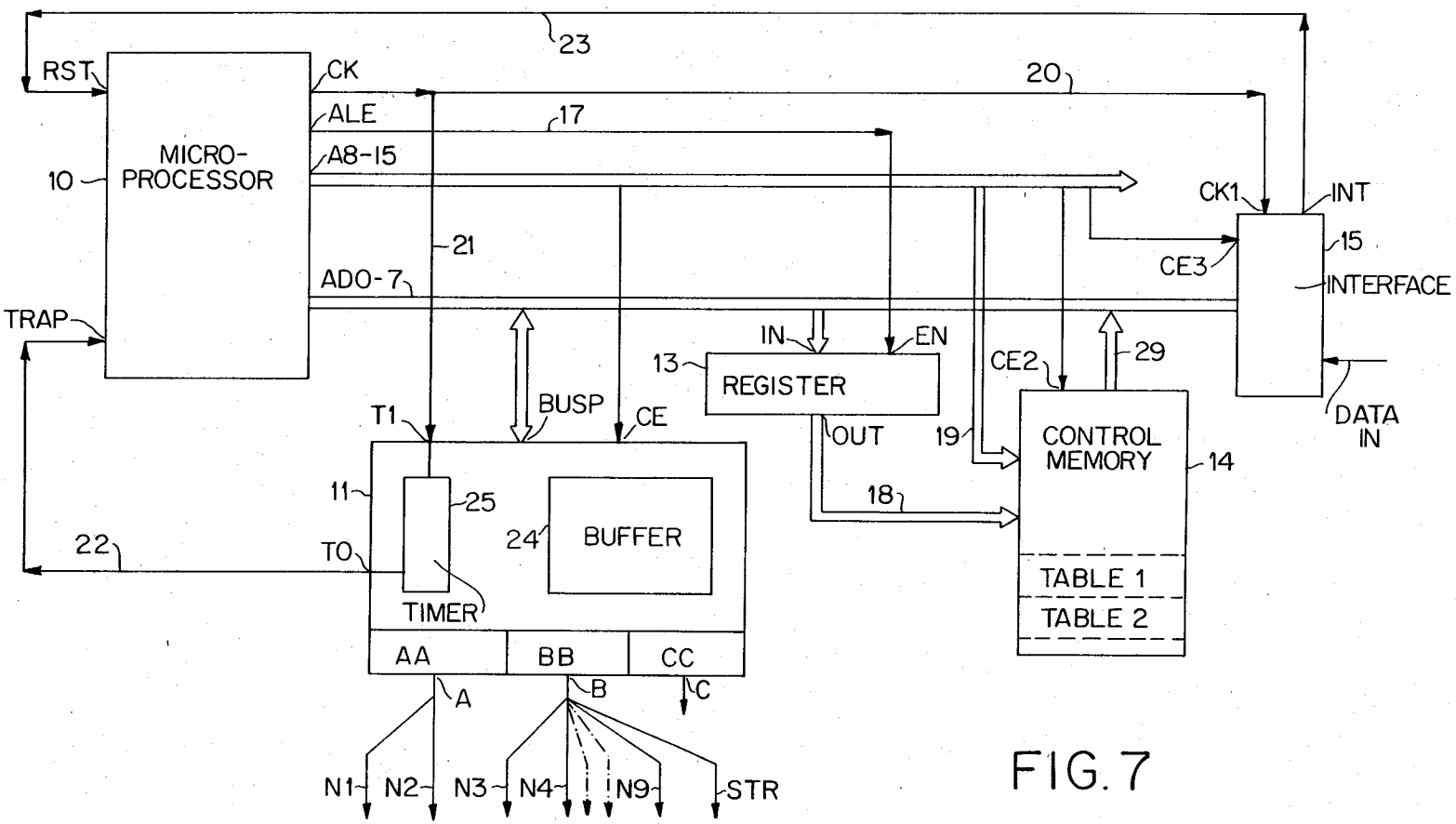
FIG. 7 shows the architecture of an electronic control system of a printer able to carry out the method of the invention.

Programmable gate 11 is provided with input/output pins BUSP connected to bus AD0–7 and with three groups of input/output gates A, B, C having 8, 8, 6 pins respectively. The gate is programmable as the transfer direction of the several input/output groups can be pre-established by means of suitable control signals. Gate 11 includes a set of 256 8 bit registers which may be used as auxiliary memory and are indicated as buffer 24 in FIG. 7, a timing counter 25 and a support register AA, BB, CC for outputs A, B, C respectively. The counter can be pre-set at a prefixed binary value. Gate 11 is further provided with:

an input T.I. for receiving timing pulses, an output T.O. for delivering a timing pulse.

The pulses received by terminal T.I. decrement the timing counter 25. When the counter decrements to zero, a timing signal is available at terminal T.O for enabling the reception of a selection/enable signal. Register 13 is provided with a set of 8 inputs IN connected to bus AD0–7, with a strobe input IEN for input signals strobing connected, through lead 17, to the microprocessor output ALE, and with a set of 8 outputs OUT. Control memory 14, having a 8 bit parallelism and a 2K byte size, is provided with 11 address inputs. Eight of these are connected, through a channel 18 to the outputs of register 13. The remaining three inputs are connected to suitable leads of channel A8–15 through channel 19. Memory 14 is provided with 8 data outputs connected to bus AD0–7 through channel 19, and has an input CE2 controlling the outputs. When CE2 is at logical level 1 the outputs are enabled. Otherwise the outputs are virtually isolated. The programmable communication interface 15 serially receives some input data signals DATA IN from a modem. As soon as a character is completely received, interface 15 delivers an interrupting signal on output INT. When interface 15 receives an enabling signal on input CE3 the received character is transferred to an 8 output set connected to bus AD0–7. The interface operations are timed by a timing signal received at an input CK1 connected to output CK of microprocessor 10 through lead 20. The enabling inputs CE1, CE2, CE3, are respectively connected to the higher weight leads A13, A14, A15 of bus A8–15. Input TI of gate 11 is connected to output CK of processor 10 through lead 21. Output TO of gate 11 is connected to input TRAP of processor 10 through lead 22. Likewise the output INT of interface 15 is connected to input RST of processor 10 through lead 23. Output set A of gate 11 has two outputs respectively connected to two leads N1, N2. Actuation signals are sent, through these two leads, to needle 1 and 2 respectively of the printing head; i.e. to the two upper needles of the printing column. Output set B of gate 11 has 7 outputs connected to leads N3, N9 respectively. Actuation signals are sent through these leads to needles 3, . . . 9 respectively of the printing head. The eighth output of set B is connected to lead STR. A STROBE signal is sent through such a lead, which, ANDed with the signal present on leads N1, . . . N9, causes the selective and simultaneous actuation of a certain number of needles. Output set C supplies control signals to the motor causing the printing carriage movement and the printing support advancement. Memory 14 stores suitable control programs for processor 10, consisting of 8 bit instructions as well as character description tables. An alphanumeric character which has to be composed in a matrix of 9 vertical dots per 7 horizontal dots is embodied by a 7 byte table. A high quality type which has to be composed in a matrix of 16 vertical dots per N horizontal dots and which is actually printed with two passes, is embodied by two N byte tables (TABLE 1 and TABLE 2 of FIG. 7).

The system operation is very simple. When interface 15 receives a character it sends an interrupt signal to the output INT, both in case such character is a type to be printed and in case it is a command (space, lead, carriage return, etc.). Such INT signal received by processor 10 starts an interruption handling program. In other words processor 10 cyclically puts suitable address information on bus AD0–7 and A8–15 and fetch from memory 14 program instructions. Because of the execution of such a program, processor 10 receives, through bus AD0–7, the character available at the output of interface 15 and handles it. If the character received is a command, the processor 10 goes on by executing it. In particular, the character received can indicate that the types to be printed must be of a high quality. In this case the processor stores the information into a suitable internal register or into buffer 24 of gate 11. As soon as a code corresponding to a letter to be printed is received, it is loaded into a "line buffer" zone. It is further used as an addressing code for memory 14 where a first character description table is identified. The first byte of such a table is read out by processor 10 and, with suitable shift operations, it is partially loaded into register A of gate 11 and the remaining part into register B. In other words the 8 bits, whose logical level 1 or 0, indicates if the corresponding needle has to be energized or not, are coupled to suitable needles. During a first printing pass 8 bits are coupled to needles 2 . . . 9. Information corresponding to a printing command is also loaded into the eighth bit of register B and the selective actuation of the needles therefore takes place. Further the timing counter is present, which then decrements the timing pulses received from intput TI. The read out memory operations, the read out byte processing operations, the A, B, register loading operations occur in few cycles of processor 10 and therefore in a few microsecond time which is negligible compared with the enabling period of the printing operations. The timing counter of gate 11 defines, through its setting to zero, the time interval between one printing operation and a subsequent one. Typically such interval may be of 2 msec. After such 2 msec the zero setting of gate 11 counter generates an interrupt signal at output TO which, when received by processor 10, causes the fetch from memory of a second byte of the character description table. The mentioned operations are repeated and the printing of a second dot column is commanded. In this way the printing of the letter corresponding to the first pass is performed. Meanwhile, if other characters to be printed have been sent from interface 15 to the system, these were stored in gate 11 memory buffer. The printing corresponding to the first pass takes place for each of these characters in order, fetched by processor 10. As soon as the printing of a line has been completed, processor 10 acts on the feeding devices of the printing support which is advanced of 1.5P. The list of the characters to be printed, stored in gate 11 buffer, is now used to inversely address the second description tables contained in memory 14. During such second pass the bytes read out from memory are coupled to needles 1 . . . 8 instead of to needles 2, . . . 9, by means of shift operations. In this way the high quality printing is completed. Clearly the second printing pass, above-disclosed as performed with reverse order; that is when the printing head is returning can also be executed in direct order if preceded by a return operation of the printing head.

The previous description only refers to the features essential to the understanding of the invention and omits those features which are not important for purposes of the invention, such as the motor control for moving the printing head or the printing support. However concise the description points out that each bit, included in the character description in memory 14, constitutes information concerning the actuation or the non-actuation of a corresponding needle and that the correlation bit/needle is arranged according to the printing pass. This selective correlation according to a printing pass is essential for the control of a 9 needle head (generally M needles) with an 8 binary code (generally M-1) and is characteristic of the present invention. Obviously such selective correlation is not essential in the case at hand having a number of needles equal or lesser than the number of bits constituting each column of the character description table, is used for quality printing. Practically, as the memories available on the market have an 8 bit parallelism the problem does not occur for the control of 7 or 8 needle heads which enable the composition of quality letters according to a matrix of 12 or 14 lines per N columns.

In the previous description it has been shown that the several character bytes to be printed, once fetched from the table are processed by processor 10 and loaded into register A, B. Practically it is also possible to process such bytes and load them in a zone of buffer 24 in order to have them ready as soon as their use is required. In this way the time interval can be further reduced between the instant when gate 11 generates the interrupt signal, corresponding to a printing timing, and the instant when the information is available in registers AA, BB. In this case processor 10 controls only the information transfer from buffer 24 to registers AA, BB with reduced number of cycles. Even if in the previous description reference is made to needles as impression elements, the invention is not limited to the field of matrix printers using impression needles and the inventive method may be suitable for all serial matrix printers where the character printing is obtained by dot composition and the dots are impressed on the printing support by a column of printing elements through impact, electrical discharge, ink thermal transfer or similar devices. Likewise the invention does not refer only to impression elements vertically arranged as to the printing line, but also to elements arranged according to inclined directions as to the printing line.

What is claimed is:

1. A high quality printing method utilizing a matrix serial printer provided with N printing elements in a column arranged with a vertical pitch P centre to centre, the printing elements being shifted transversally to said column along a printing support line and being selectively actuated during said transverse movement, the printer comprising means for advancing said printing support in the direction of said column of elements for a discrete multiple quantity of an elementary advance equal to 1.5 times the vertical pitch of said elements comprising:

executing a first line printing operation through a first transverse pass of said elements;

advancing of said printing support in the direction of said elements in said column;

executing a second printing operation of said line with a second transverse pass of said elements;

said element actuation being effected by a command of a first and second succession of binary codes of N-1 bits, each succession being contained in a different table of a character description memory and read out one at a time from said memory; the first printing operation with a first pass being performed in response to each of the N-1 binary code bits of said first succession with each of the lower N-1 elements in said N elements column and the second printing operation being performed in response to each of the N-1 binary code bits of said second succession with each of the upper N-1 elements in said N elements in the column.

* * * * *